US006789594B1

(12) United States Patent
Yu Chen

(10) Patent No.: US 6,789,594 B1
(45) Date of Patent: Sep. 14, 2004

(54) TAPE DISPENSER WITH A HIDDEN BLADE

(76) Inventor: Hsiu-Man Yu Chen, No. 27, Sec. 1, Ta Fu Road, Tan Tzu Hsiang, Taichung (TW), 427

( * ) Notice: Subject to any disclaimer, the term of this patent is extended or adjusted under 35 U.S.C. 154(b) by 0 days.

(21) Appl. No.: 10/422,910

(22) Filed: Apr. 25, 2003

(51) Int. Cl.[7] ..... B32B 31/00

(52) U.S. Cl. ..... 156/523; 156/577; 156/579; 225/19; 225/20; 225/56

(58) Field of Search ..... 156/523, 574, 156/577, 579, 527, 576; 225/19, 20, 56, 72, 77, 89, 91

(56) References Cited

U.S. PATENT DOCUMENTS 4,486,263 A * 12/1984 Monzo Gomez ..... 156/523
4,591,407 A * 5/1986 Samuelson ..... 156/527
5,073,228 A * 12/1991 Lin ..... 156/523
5,197,386 A * 3/1993 Lin ..... 101/213

* cited by examiner

*Primary Examiner*—Richard Crispino
*Assistant Examiner*—Cheryl N. Hawkins
(74) *Attorney, Agent, or Firm*—Troxell Law Office PLLC

(57) ABSTRACT

A tape dispenser with a hidden blade includes a body, a press plate provided at a front side of the body and possible to be pressed to move rearward elastically to push down a blade fixed on a blade base to force the blade to protrude out of the body a little for cutting a tape. After the tape is cut and the press plate is released manually, the blade with the blade base together is raised up to the original position elastically and automatically, kept safe to use and prevented from damage by accidental collision by something.

6 Claims, 7 Drawing Sheets

TAPE DISPENSER WITH A HIDDEN BLADE

BACKGROUND OF THE INVENTION

1. Field of the Invention

This invention relates to a tape dispenser with a retractable blade, particularly to one having a blade for cutting tape normally hidden in a body, and able to be pulled out for cutting a tape by pressing a press plate in case of need of cutting the tape after the tape is adhered on an object.

2. Description of the Prior Art

A common conventional tape dispenser 10 shown in FIG. 1 includes a body 11, a blade 12 and a liftable cover 13 as main components combined together. The blade 12 is directly fixed firmly on the front lower side of the body 11, always exposed outside for cutting an adhered tape. The body 11 further has a tape cylinder supporter 111 formed integral at the rear portion of the body 11 for a tape cylinder 20 to be fitted thereon, and a tape hole 112 formed in front of the tape cylinder supporter 111 for the tape on the tape cylinder to be pulled out to pass through. The liftable cover 13 is pivotally connected with the body 11 and on the tape cylinder supporter 111, hiding the tape and the tape cylinder supporter 111 to let the tape extend out of the tape cylinder 20.

However, the conventional tape dispenser has its blade 12 fixed firmly and exposed out of the body 11, quite liable to be damaged by collision with something and to harm a user's finger in case of careless and inadvertent handling of the tape dispenser. In addition, a user must have some kind of handling technique or using experience of the dispenser, otherwise the user may not be able to smoothly cut a tape because of the fixed condition of the blade. Thus adhering a tape on an object may be affected.

SUMMARY OF THE INVENTION

This invention has been devised to offer a tape dispenser with a hidden blade, which includes a body, a press plate to be pressed manually to force a blade fixed on a blade base to move a little out of the body to cut an adhered tape on an object only in case of need. If the pressed press plate is manually released, then the blade with the blade base is automatically retracted back elastically to the original position hidden in the body.

The blade is normally hidden in the body, prevented from damage by accidental collision with something, or from harming by careless contact by a person's finger.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
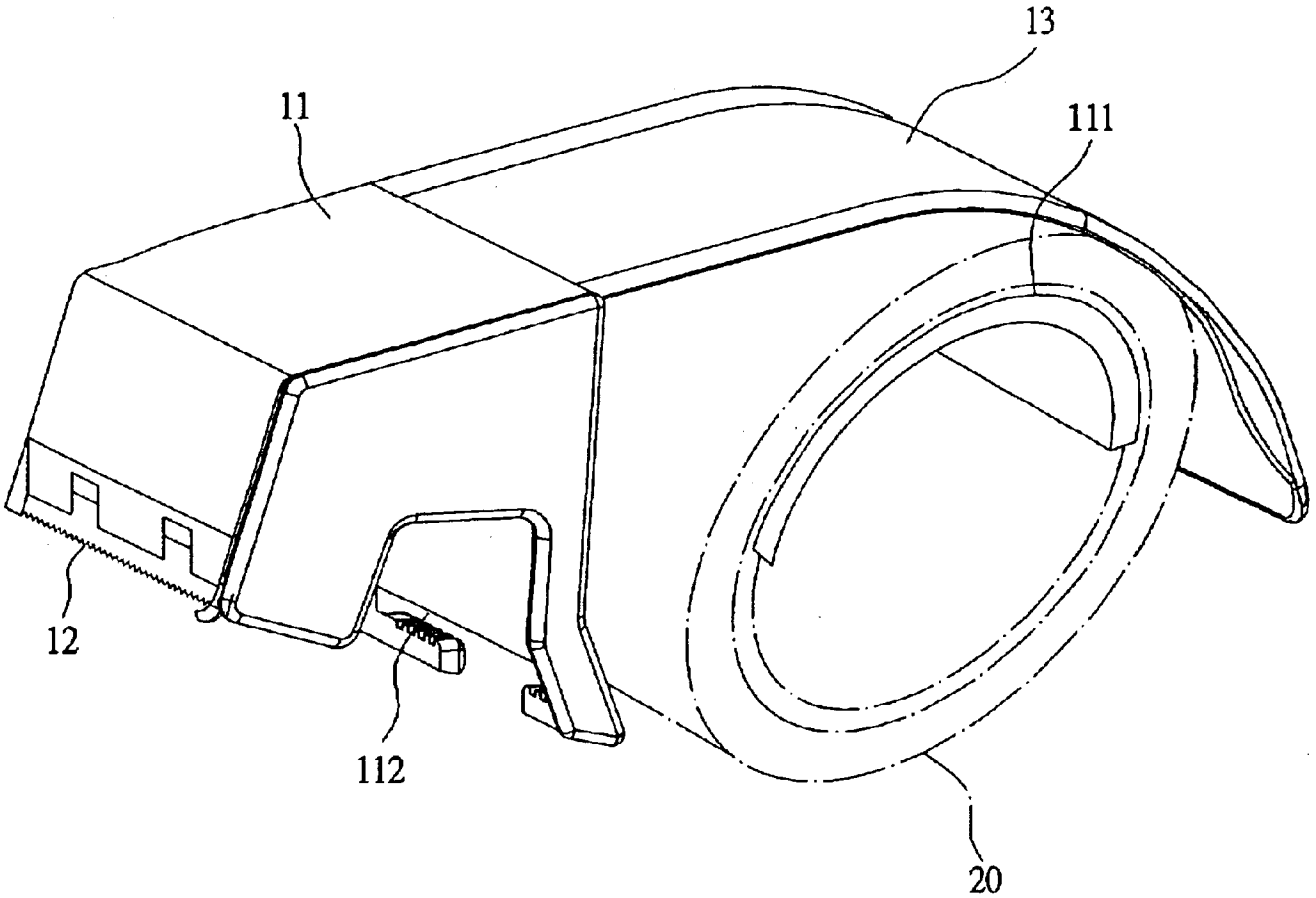
FIG. 1 PRIOR ART
FIG. 1 is a perspective view of a conventional tape dispenser.
Figure 2:
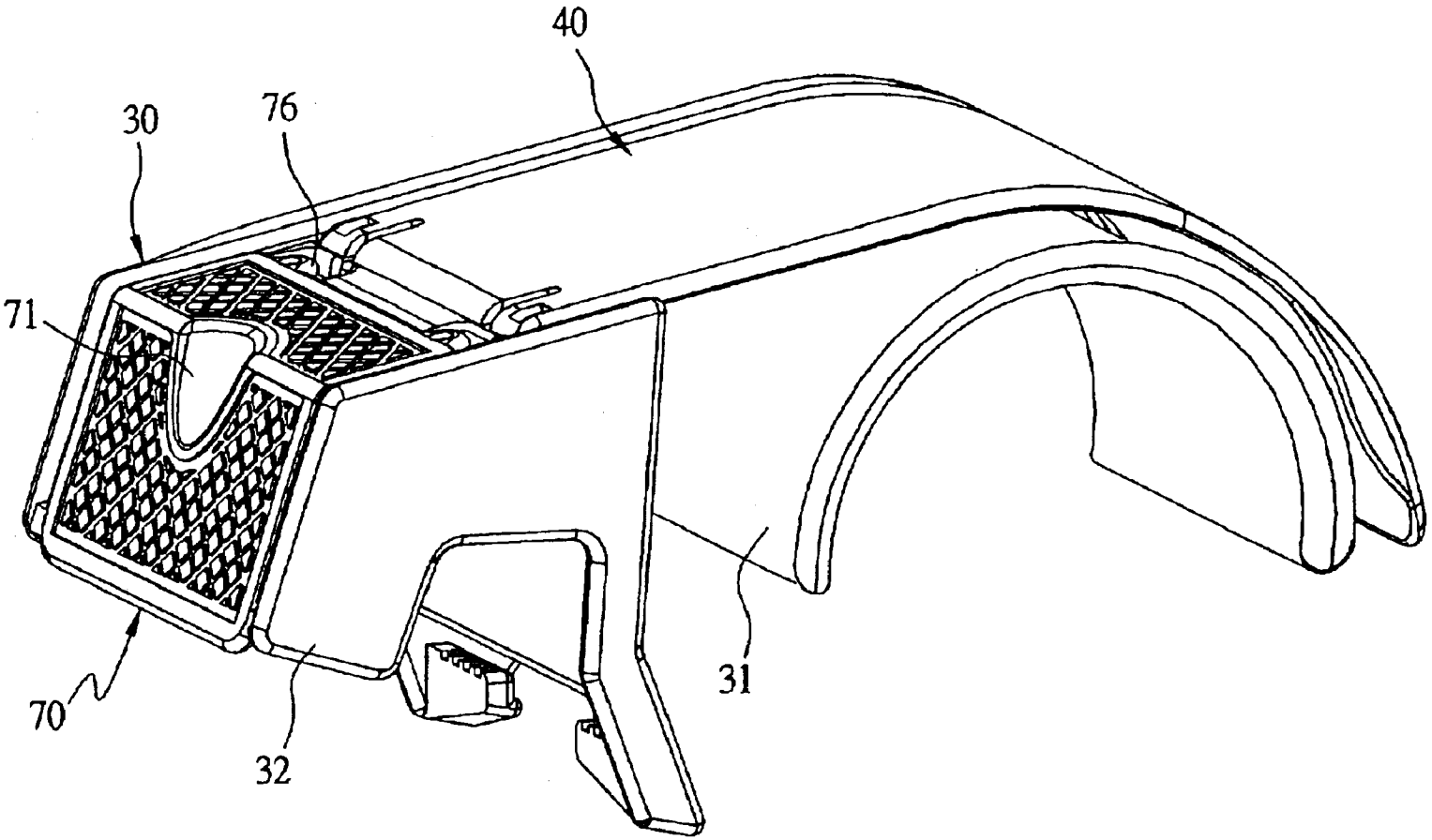
FIG. 2 is a perspective view of a tape disperser with a hidden blade in the present invention.

A preferred embodiment of a tape dispenser with a hidden blade in the present invention, as shown in FIG. 2, includes a body 30 almost as the same structure of the body of the conventional tape disperser described above, a liftable cover 40 and a blade 50, a blade base 60, and a press plate 70, as main components combined together.

The body 30 has a tape cylinder supporter 31 formed in a rear portion for fitting a tape cylinder thereon, and the liftable cover 40 is pivotally connected with the body 30 on the tape cylinder supporter 31 for hiding the tape cylinder and a tape fitted thereon, and can be pressed down to stop rotation of the tape cylinder and subsequently stop the tape from pulled out. The blade 50 is assembled in the lower portion of the body 30.

Figure 3:
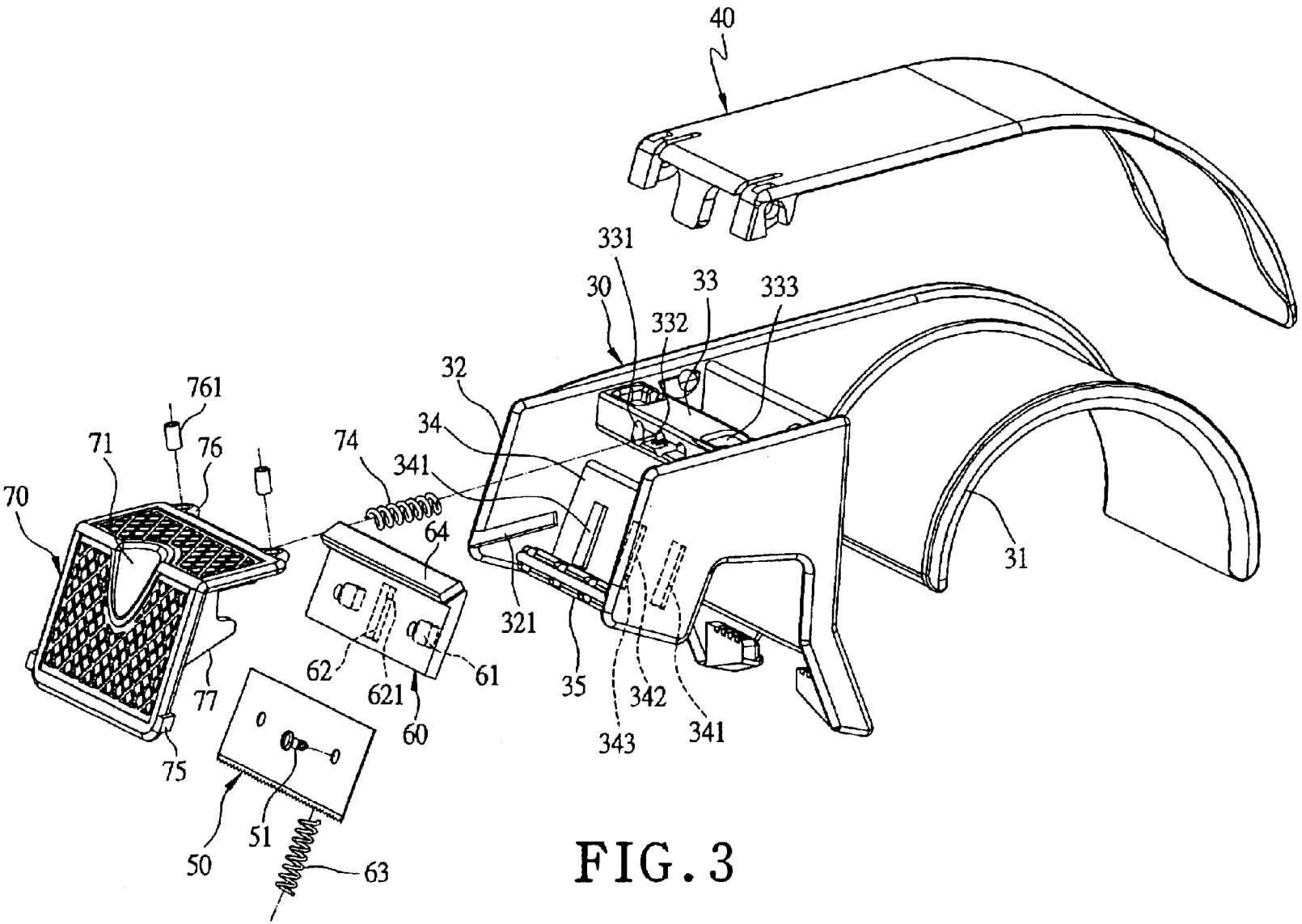
FIG. 3 is an exploded perspective view of the tape dispenser with a hidden blade in the present invention.
Figure 4:
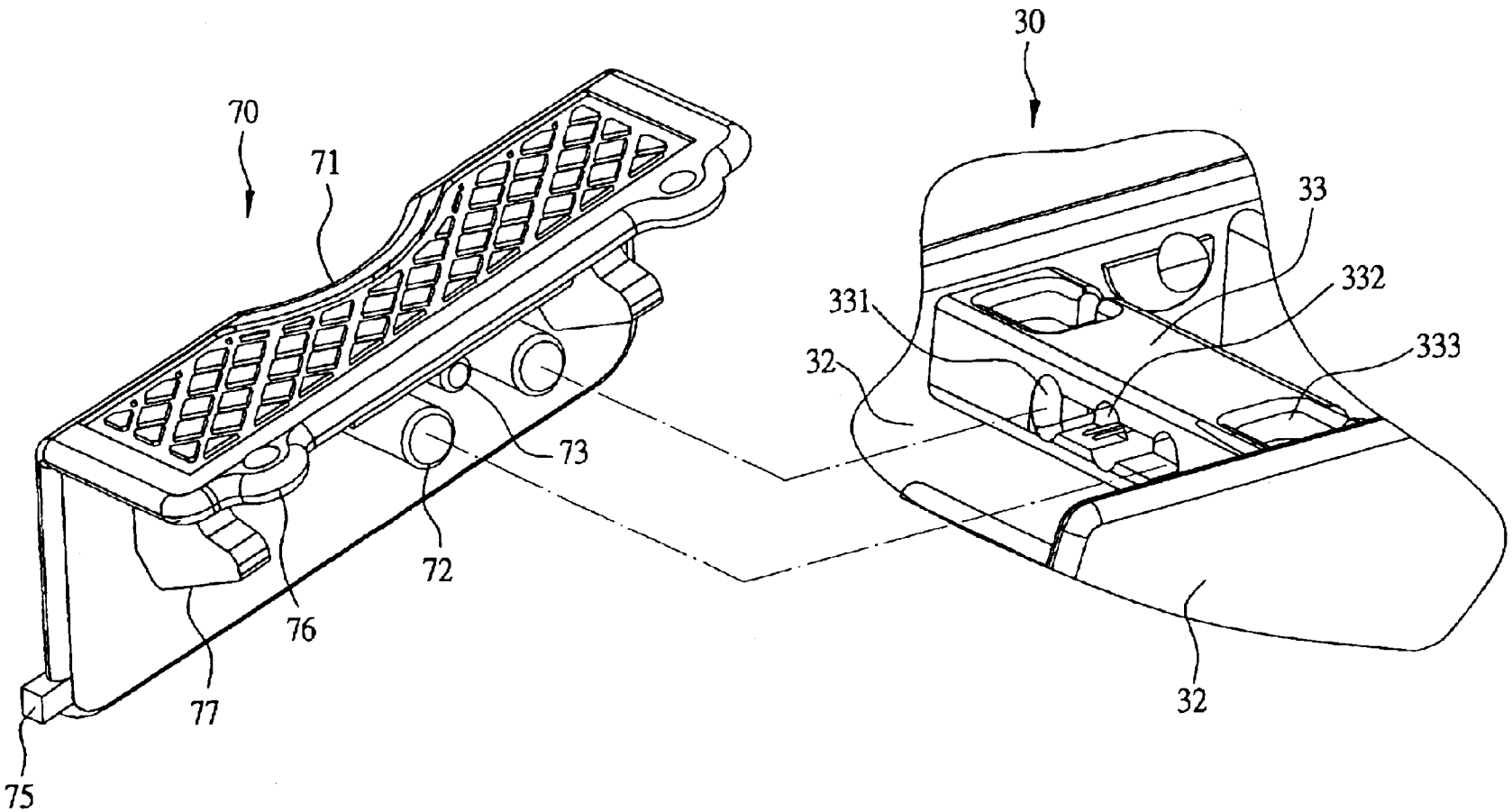
FIG. 4 is a perspective view of the relative condition of a press plate and a press plate positioning member in the present invention.
Figure 5:
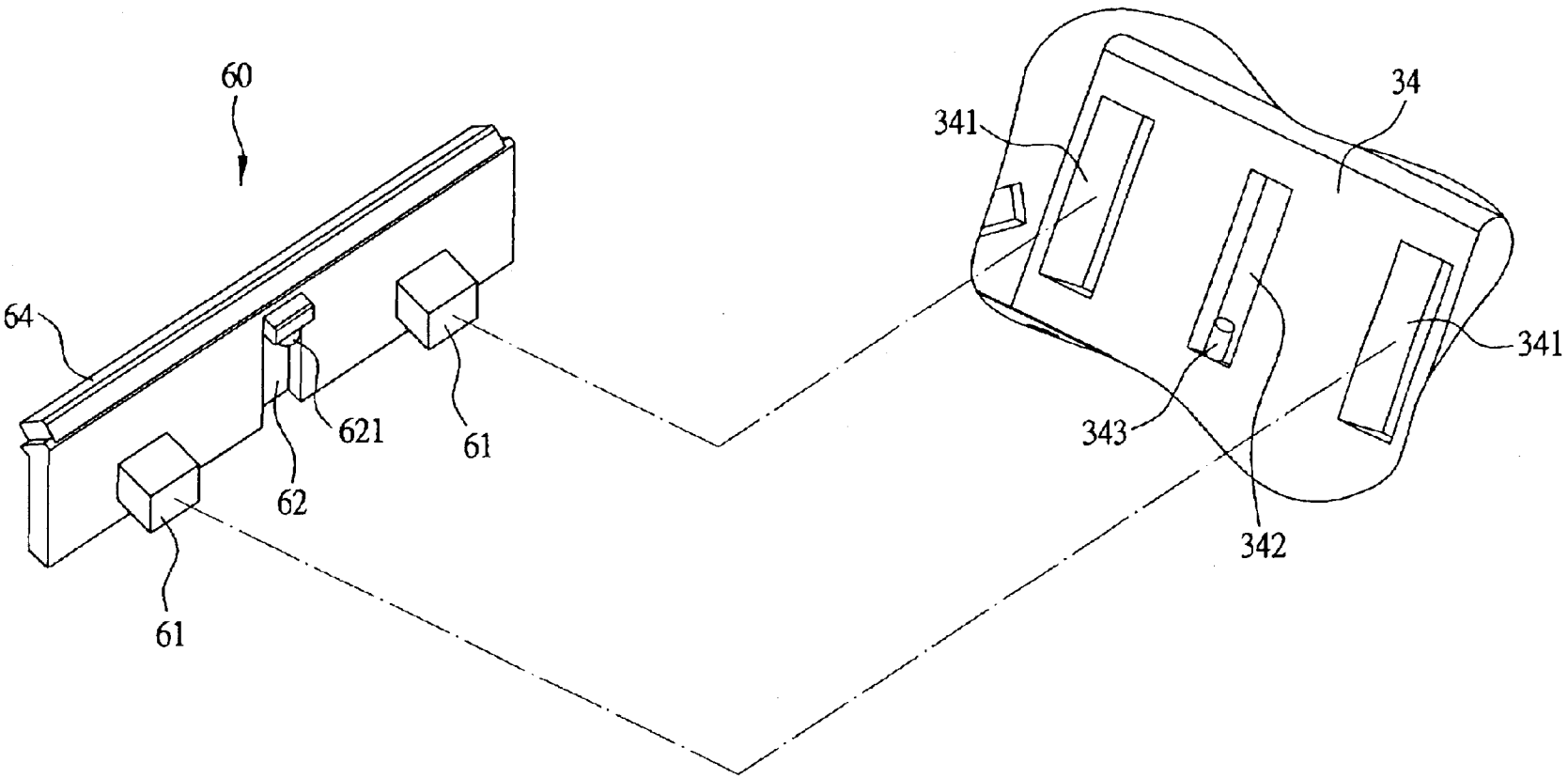
FIG. 5 is a perspective view of the relative condition of a blade base and a blade base-positioning member in the present invention.

Next, as shown in FIGS. 3 and 4, the body 30 further has two parallel side plates 32 formed in a front portion, and each side plate 32 has a lengthwise guide slot 321 formed in a front lower portion, a press-plate positioning member 33 provided in an upper portion of the space between the two side plates 32 and a blade-base positioning member 34 in a lower portion of the space between the two side plates 32. Then as shown in FIG. 4, the press-plate positioning member 33 has two sides of a front surface respectively provided with a press-plate insert groove 331, and a spring groove 332 provided between the two press-plate insert grooves 331, and a limit recess 333 formed in two sides of an upper surface. Further, as shown in FIG. 5, the blade base supporting member has two vertical slide slots 341 formed in two sides of the front surface and a spring groove 342 formed between the two slide slots 341. The spring groove 342 has a spring positioning member 343 at its bottom. A stop plate 35 is provided at in front of the bottom of the blade-base positioning member 34 to define an aperture 36 to receive the blade base 60 and a blade 50 therein.

The blade base 60 is shaped as a plate, as shown in FIGS. 3 and 5, having a front surface fixed with the blade 50 by a screw 51 to move together and two slide blocks 61 fixed spaced apart on a rear surface and a vertical spring groove 62 formed between the two slide blocks 61 Then the slide block 60 fits with the blade-base positioning member 34 of the body 3 by mutual engagement of the two slide blocks 61 with the two limit grooves 341 and slides in a limited distance. Further, the spring groove 62 has a spring positioning member 621 in its upper end, and a blade-base spring 63 is positioned in the spring groove 62 between the spring positioning member 621 and the spring positioning member 343 of the blade-base positioning member 34 so as to always push up elastically the blade base 60 with the blade 50 hidden in the body 3. Further, the blade base 60 has a level sloped surface 64 formed in an upper side so that the blade 50 may protrude down out of the blade aperture 36 when the blade base 60 with its upper sloped surface 64 is pressed by the press plate 70 pressed manually for cutting a tape.

The press plate 70, as shown in FIG. 4, has a horizontal portion and a vertical portion, with a recessed press member 71 formed in a center portion of the connect line of the horizontal and the vertical portion. The press plate 70 further has two guide bars 72 provided laterally rearward and spaced apart on a rear surface of the vertical portion to fit in the press plate insert grooves 331 of the press-plate positioning member 33 and slide therein, and a spring positioning bar 73 provided laterally between the two guide bars 72 on the rear surface of the vertical portion for a press-plate spring 74 positioned between the spring positioning bar 73 and the spring groove 332 of the press-plate positioning member 33. Further, two projecting slide blocks 75 are provided respectively at two opposite lower sides of the vertical portion, fitting with the guide grooves 321 of the two side plates 32 of the body 3 and slide therein. At the same time, the press plate 70 has two cars 76 formed at two ends of the rear side of the horizontal portion to align with the two limit recesses 333 of the press-plate positioning member 33 for two pins 761 to insert therein so as to let the press plate 70 move in a limited distance. In addition, the press plate 70 has two actuating walls 77 provided spaced apart on the rear surface of the vertical portion and having respectively a lower sloped surface. Then when the recessed press member 71 of the press plate 70 is pressed inward for a preset distance to let the press plate 70 slide rearward, the actuating walls 77 press accordingly the upper sloped surface 64 of the blade base 60 to force the blade 50 protrude down through the aperture 36 for cutting a tape.

Figure 6:
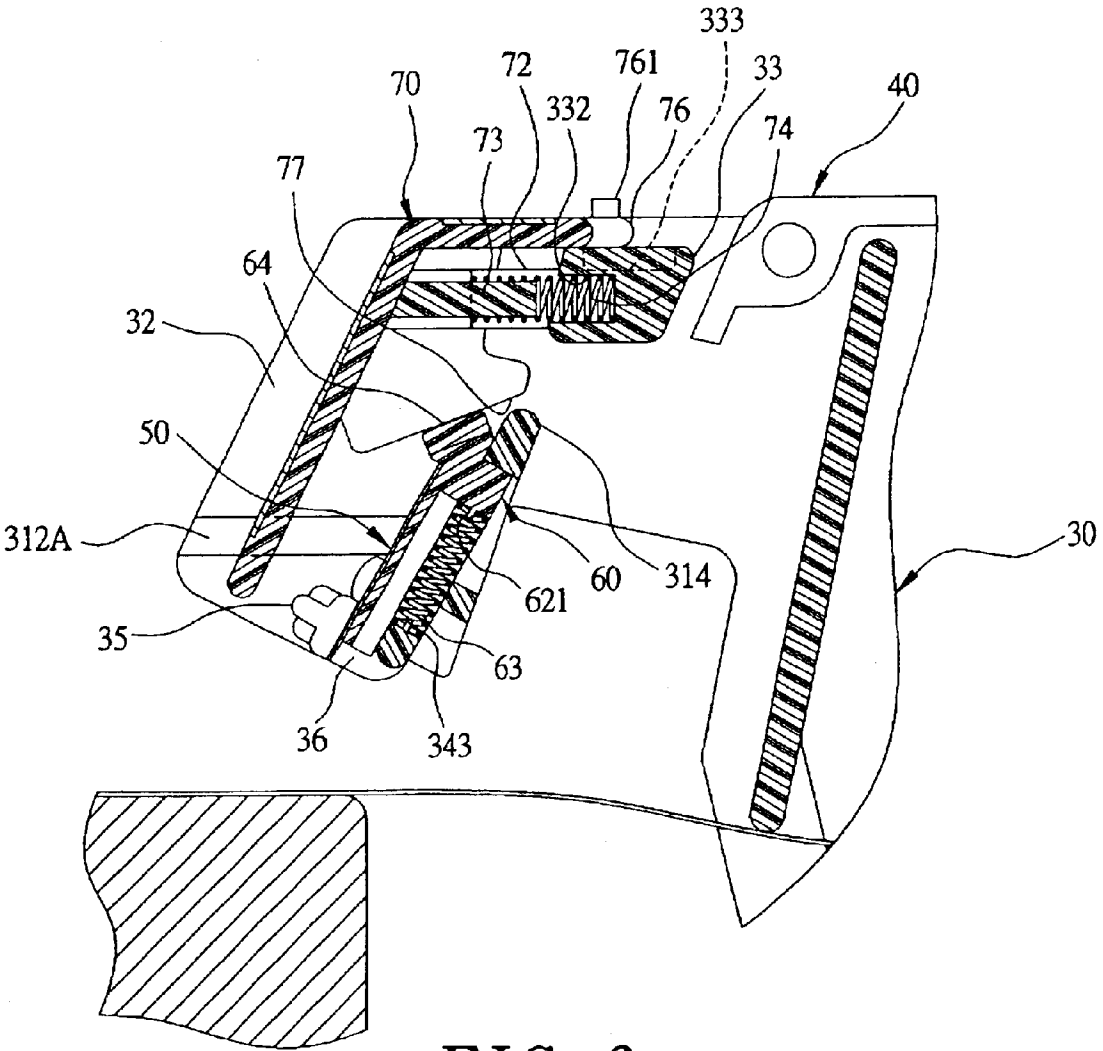
FIG. 6 is a cross-sectional view of the tape dispenser with a hidden blade in the present invention; and, FIG. 7 is a cross-sectional view of the tape disperser with a hidden blade pulled out a little for cutting a tape in the present invention.
Figure 7:
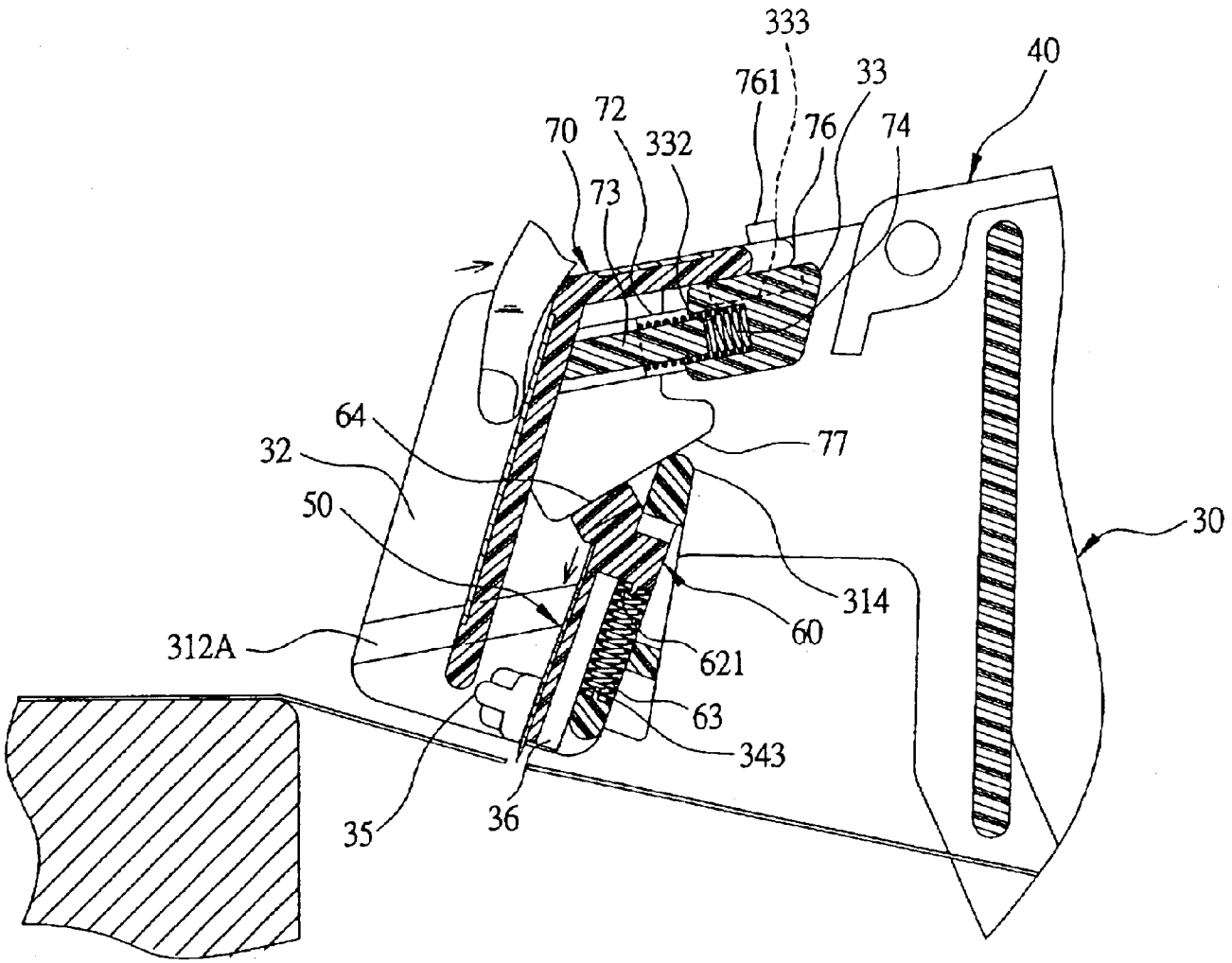

In using, referring to FIGS. 6 and 7, after the tape on the tape dispenser is adhered on an object, a user presses manually on the press member 71 of the press plate 70, and the press plate 70 will be moved backward for a preset distance by means of the three guide slide structures of the guide rod 72 with the press-plate insert grooves 331, the pins 761 of the ears 76 with the limit slide grooves 333, and the slide blocks 75 with the guide grooves 321. Then the actuating walls 77 push slantingly down the upper sloped surface 64 of the blade base 60 to force the blade 50 on the blade base 60 to move down a little to protrude down through the blade aperture 36 for cutting the tape adhered on the object by means of the compressed resilience of the press plate spring 74 and the blade base spring 63. If the press plate 70 is released manually, the blade 50 with the blade base 60 is pushed back automatically by the blade-base spring 63 recovering its resilience, and with the press-plate spring 74 also recovering its resilience to push back the press plate 70 to its original position, ready for a next operation.

In general, the tape dispenser with a hidden blade in the invention has its blade normally hidden and pulled out for cutting a tape only when it is needed, ensuring a user in safety in using it for cutting the tape after the tape is adhered on an object, and preventing the blade from being damaged by accidental collision by something to maintain a long service life of the tape dispenser.

While the preferred embodiment of the invention has been described, it will be recognized and understood that various modifications may be made therein and the appended claims are intended to cover all such modifications that may fall within the spirit and scope of the invention.

What is claimed is:

1. A tape dispenser with a hidden blade comprising a body, a tape cylinder supporter formed behind said body for fitting a tape cylinder for a tape thereon, a cover formed integral with said body to cover said tape cylinder supporter, a blade positioned in a front side of said body for cutting a tape; and, characterized by said body having two side plates formed parallel in the front portion, a press plate positioned movably back and forth in the front side and an upper side between said two side plates, said press plate having two actuating walls formed to extend rearward on a rear surface of a vertical portion, a blade-base positioning member provided under a horizontal portion of said press plate between an upper portion of the space defined by said two side plates, a blade base fixed on a front surface of said blade-base positioning member, said blade base pushed normally by elasticity, a blade fixed on a front surface of said blade base, a sloped surface formed in an upper side of said blade base to contact with lower sloped surfaces of said two actuating walls, said blade fixed on said blade base pushed down to extend down through said body for cutting a tape and to be raised again to its original position elastically.

2. The tape dispenser with a hidden blade claimed in claim 1, wherein a press-plate positioning member has two press-plate insert grooves formed spaced apart in a front surface and two position-limiting slide grooves spaced apart in an upper surface, said press plate has two ears formed spaced apart at two ends of a rear end of a horizontal portion so that said press plate may move a limited distance by means of two guide bars fitting with said press-plate insert grooves of said press-plate positioning member and said ears and said position-limiting slide grooves fitted in by pins.

3. The tape dispenser with a hidden blade as claimed in claim 1, wherein a press-plate positioning member and a two guide bars have respectively corresponding spring grooves and corresponding spring positioning projections so a press-plate spring may be positioned between the both in order to elastically push said press plate outward always.

4. The tape dispenser with a hidden blade as claimed in claim 1, wherein a recessed spring groove is provided respectively and correspondingly in a center portion of said blade-base positioning member and of said blade base, a spring positioning member is formed at an upper end and a lower end of said spring groove so that a spring is positioned between said two spring positioning members in order to push elastically upward always.

5. The tape dispenser with a hidden blade as claimed in claim 1, wherein said two side plates of said body respectively have a press-plate guide slot lengthwise and respectively in their inner surfaces, said press plate has two slide blocks respectively at two opposite sides of a lower end of the vertical portion, and said press plate is combined with said two side plates by means of said two slide blocks fitting movably in said two press-plate guide slots.

6. The tape dispenser with a hidden blade as claimed in claim 1, wherein said blade-base positioning member has two vertical slide grooves in two sides of a front surface, said blade base has two slide blocks on a rear surface correspondingly fitting movably in said two vertical slide grooves to enable said blade base to slide a limited distance relative to said blade-base positioning member.

* * * * *